US005675241A

United States Patent [19]

Teggatz et al.

[11] Patent Number: 5,675,241

[45] Date of Patent: Oct. 7, 1997

[54] VOLTAGE REGULATOR WITH LOW DROP OUT VOLTAGE

[75] Inventors: Ross E. Teggatz, McKinney; Joseph A. Devore; Jonathan R. Knight, both of Dallas, all of Tex.

[73] Assignee: Texas Instruments Incorporated, Dallas, Tex.

[21] Appl. No.: 672,125

[22] Filed: Jun. 27, 1996

Related U.S. Application Data

[60] Provisional application No. 60/000,894, Jul. 06, 1995.

[51] Int. Cl.[6] ..... G05F 1/56; G05F 5/00

[52] U.S. Cl. ..... 323/282; 323/303

[58] Field of Search ..... 323/226, 273, 323/274, 282, 284, 303

[56] References Cited

U.S. PATENT DOCUMENTS

| | | | |
|---|---|---|---|
| 4,543,522 | 9/1985 | Moreau | 323/303 |
| 4,779,037 | 10/1988 | Locasio | 323/275 |
| 4,906,913 | 3/1990 | Stanojevic | 323/303 |
| 5,510,697 | 4/1996 | Dormer | 323/282 |

*Primary Examiner*—Matthew V. Nguyen
*Attorney, Agent, or Firm*—Mark E. Courtney; W. James Brady, III; Richard L. Donaldson

[57] ABSTRACT

A circuit and method for providing a low drop out voltage regulator. A source follower circuit is provided having a transistor (MD1) with an output terminal for driving a load at its source terminal and a voltage supply coupled to the drain terminal. At least one diode (D1) is coupled between the gate terminal and a ground reference to provide a predetermined voltage at the gate of the transistor (MD1). A voltage multiplier circuit is provided having an input (IN) for receiving an oscillating input voltage and a charge storage device (39) coupled between the oscillating input and a voltage reference (Vref), and being further coupled in series with the voltage reference and then to the gate terminal of the transistor (MD1). The oscillating input voltage is used to charge the charge storage device (39) to a voltage approximately equal to the voltage reference. When the supply voltage falls below the normal level, the series combination of the voltage reference and the charge storage device provides a multiplied voltage at the gate of the transistor, for example a voltage of twice the reference voltage. This high gate voltage keeps the output at the source of the transistor at a high voltage that is approximately equal to the supply voltage, such that the circuit provides a low drop out voltage under low supply voltage conditions.

16 Claims, 2 Drawing Sheets

VOLTAGE REGULATOR WITH LOW DROP OUT VOLTAGE

This application is a provisional of application Ser. No. 60/000,894 filed Jul. 6, 1995.

FIELD OF THE INVENTION

This invention relates generally to the field of source follower Voltage regulator circuits and integrated circuits including voltage regulator circuitry.

BACKGROUND OF THE INVENTION

In voltage regulator circuits, it is desirable to provide an output voltage that maintains a regulated voltage at a desired level, even as the supply voltage to the circuitry drops. This is typically expressed as a "low drop out voltage" requirement. The output voltage is required to be maintained at as high a level as is possible given the low supply voltage condition. Many prior art regulator circuits cannot meet the requirement for regulated output at low supply voltages.

For example, many analog signal integrated circuits or mixed signal integrated circuits have an external supply voltage that must be regulated internally. A typical circuit 11 to provide this regulated voltage is shown in FIG. 1. A source follower configuration transistor MD1 is used to follow the supply voltage Vsupp and output a moderately well regulated output voltage Vreg. In FIG. 1, supply voltage Vsupp is coupled to a current source I1 which provides a predetermined current. Zener diodes D1 and D2 are serially coupled to provide a fixed voltage Vzen at the gate of voltage follower transistor MD1. The drain of MD1 is coupled to the supply voltage. The output voltage Vreg is then controlled by the supply voltage and the gate to source voltage Vgs.

In operation, first consider that the supply voltage Vsupp is at or above its desired normal operating level. As an example, assume the system design calls for a supply voltage Vsupp of 13 Volts. The gate of source follower transistor MD1 is at the voltage set up by the voltage drop across the serially coupled zener diodes D1 and D2. Typically, but only as one alternative, this might be a voltage also of 13 Volts. The gate-to-source voltage drop Vgs of the transistor MD1 will typically be around 2 Volts. Accordingly, the voltage Vreg across load resistor $R_L$ at the source terminal of the transistor MD1 will be 11 Volts. This may be modified by lowering the number or voltage characteristics of the diodes D1 and D2 that set the voltage Vzen at the gate of transistor MD1, but the output voltage Vreg will always be less than the gate voltage Vzen by the gate to source voltage drop Vgs.

Now consider a situation where the supply voltage Vsupp is low. This can happen for a variety of reasons. Typically, this occurs in a battery operated or portable system such as a portable instrument, automotive, shipboard or airborne system, or a laptop computer. When the supply battery is low, it is unable to provide the normal voltage level at terminal Vsupp. Suppose Vsupp falls to a voltage of 5 Volts. The desired voltage at output Vreg is 11 Volts, or in any event the output voltage should be as close to the designed output voltage as possible. Using the analysis above, it can be seen that with a supply voltage of 5 Volts, the voltage at the gate of the transistor MD1 is also necessarily limited to 5 volts. The gate-to-source drop voltage Vgs remains the same, about 2 Volts. Thus, the output voltage Vreg of the circuit ends up at only 3 Volts, far less than is available at the supply.

At a voltage supply of 5 Volts, the circuit should be able to supply analog circuits. However, a regulated output voltage of 3 Volts is too low to power many analog circuits. Many automotive applications require operation in a supply voltage range from 5 Volts to 24 Volts. The voltage follower of FIG. 1 will not work in these environments to meet the requirements of these applications.

FIG. 2 is a voltage input vs. voltage output curve for voltages Vsupp and Vreg in the prior art circuit of FIG. 1. When Vsupp is less than around 2 Volts, the output voltage Vreg is zero. As Vsupp increases to 5 volts, the output voltage Vreg is about 3 Volts. This is inadequate to operate many circuits, although the 5 volt supply voltage would be adequate. As Vsupp continues to increase Vreg also increases, although it remains about 2 Volts below the supply voltage. Finally when the supply voltage reaches the specified design level of 13 Volts in this example, the output voltage is regulated to about 11 Volts.

FIG. 2 dearly shows that the circuit of FIG. 1 will provide a lower voltage at Vreg than is needed to operate the circuit when the supply voltage drops below its designed for levels. This circuit is therefore inadequate in that it fails to meet the low drop out voltage requirement for many applications and systems.

Accordingly, a need thus exists for a source follower-type voltage regulator circuit that overcomes the shortcomings of the prior art circuits. The improved voltage regulator circuit should provide a regulated output that will remain at or near the supply voltage level when the supply voltage falls below the designed for supply voltage level, so as to provide a low drop out voltage.

SUMMARY OF THE INVENTION

A circuit and method for a voltage regulator circuit with a low drop out voltage output is provided. The improved circuit has a voltage multiplier coupled to a reference voltage and an oscillating input. The oscillating signal drives a charge pump circuit to provide an output that has a voltage level that is a multiple of the reference voltage. The multiplied reference voltage is coupled to a source follower output transistor and provides a high voltage level at the gate of the source follower output transistor. This high voltage enables the circuit to provide a higher regulated output voltage when the supply voltage falls below a threshold level.

BRIEF DESCRIPTION OF THE DRAWINGS

Corresponding numerals are used for corresponding elements in the drawings, unless otherwise indicated in the text.

DETAILED DESCRIPTION OF PREFERRED EMBODIMENTS

Figure 3:
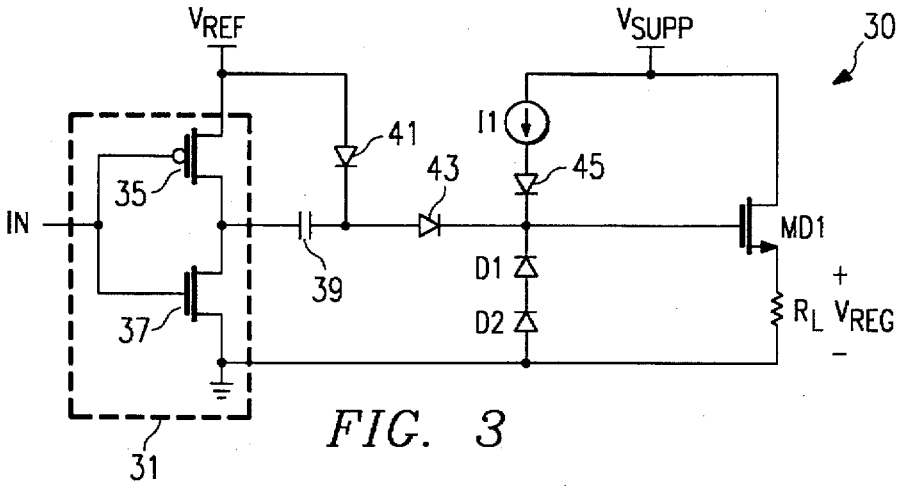
FIG. 3 depicts the improved source follower circuit of the invention.

FIG. 3 depicts a first embodiment of the source follower circuit 30 of the invention. In FIG. 3, an inverter 31 is comprised of transistors 35 and 37. For a CMOS inverter, the transistor 35 is a PMOS transistor and the transistor 37 is an NMOS transistor. Inverter 31 is coupled to an input pin IN. Capacitor 39 is coupled to the output of inverter 31, and has an output terminal. Diode 41 couples the output terminal of capacitor 39 to the reference voltage Vref and diode 43 couples the output of capacitor 39 to the gate input of source follower transistor MD1. The gate input of transistor MD1 is coupled to a zener diode stack comprised of serially coupled diodes D1 and D2, and to the supply voltage Vsupp by the diode 45 and a current source I1. The drain terminal of transistor MD1 is coupled to the supply terminal Vsupp and the source terminal is coupled to the load transistor $R_L$. The output voltage Vreg is the voltage across resistor $R_L$.

Figure 5:
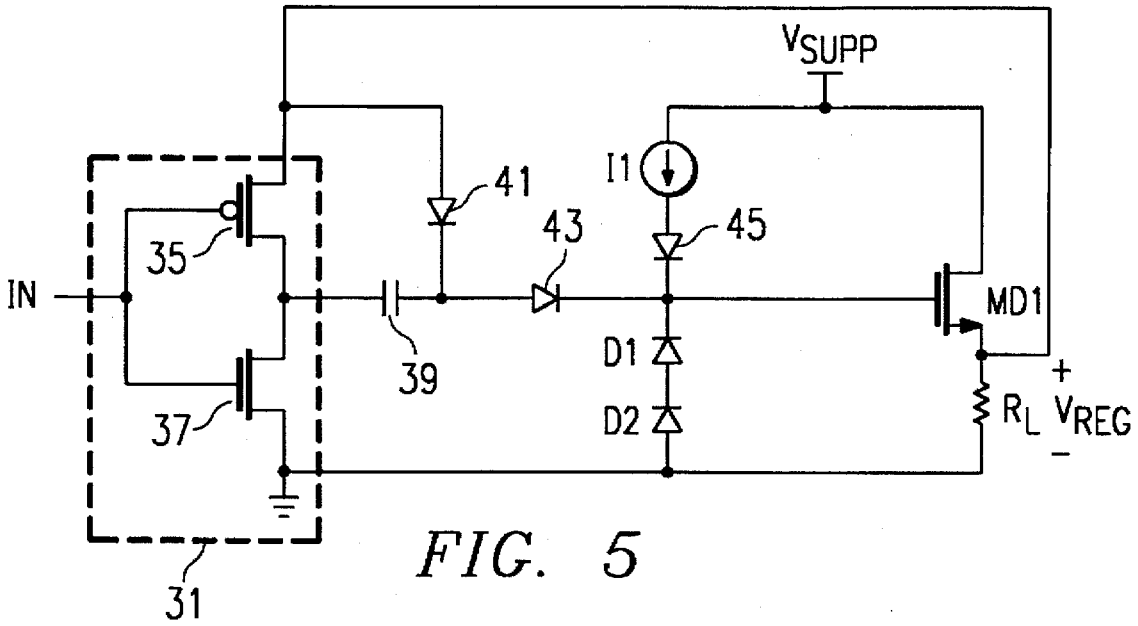
FIG. 5 depicts an alternative embodiment to the source follower circuit of FIG. 3.

In operation, a voltage multiplier circuit is provided that is comprised of inverter 31, capacitor 39, diode 41 and diode 43. This voltage doubler circuit operates to provide a voltage into the source follower at the gate of transistor MD1 that is approximately doubled from the voltage Vref. Alternatively, the voltage can be tripled, quadrupled, etc, as is known in the art. Typically, the voltage Vref is a voltage that is available in the circuitry and is lower than Vsupp, often Vref is 5 Volts. FIG. 5 depicts an embodiment wherein the output voltage Vreg can be coupled to the doubling circuit when no reference is available. The multiplier circuit operates as follows. When the output of the inverter 31 is at a low voltage, the capacitor 39 is placed between Vref and ground, and charges to voltage Vref. In contrast, When the output of the inverter 31 is a high voltage, the charged capacitor 39 is placed in series with voltage Vref. An oscillating input is required at the input terminal IN to charge the capacitor 39. Because the input to the inverter 31 and capacitor 39 is oscillating at a fairly rapid frequency, the DC voltage output at the output of diode 43 is approximately 2 * Vref, once the capacitor 39 receives an initial charge. Diode 41 keeps the current at the output of the capacitor 39 from flowing back towards the reference voltage supply Vref. Diode 43 allows the current to flow into the gate terminal of transistor MD1. Diode 45 prevents current from discharging into the supply voltage Vsupp when Vsupp is a lower voltage than the voltage at the gate of transistor MD1.

The voltage level at the gate terminal of transistor MD1 is normally the voltage set by the diodes D1 and D2. Typically this voltage approximates the same level as the supply voltage, Vsupp, or around 13 Volts. When that is the case, the multiplied voltage at the output of diode 43 does not change the operation of the overall circuit, so that the output voltage Vreg across the load resistor $R_L$ is equal to the voltage across the diode stack minus the gate-to-source voltage drop Vgs for the transistor MD1. Typically the output voltage will be 11 Volts in this example. The gate-to-source voltage Vgs can vary with transistor design and the process technology, so other output voltages are possible, but generally the output voltage Vreg will be less than the diode stack voltage Vzen by the gate to source voltage drop Vgs for device MD1.

Now consider the operation of the circuit of FIG. 3 when the supply voltage Vsupp drops below the multiplied voltage, in this example a voltage of 2 * Vref. Now the voltage at the gate terminal of MD1 is held at 2 * Vref by the output of diode 43. The output voltage is now a gate to source drop below the multiplied voltage, or around 8 Volts when the voltage 2 * Vref is 10 Volts. As the supply voltage Vsupp drops below 10 Volts, the output voltage Vreg is maintained at the level of 8 Volts by the operation of the voltage doubler circuit, which maintains a voltage of 2 Vref, or around 10 Volts in this example, at the gate of the transistor MD1.

Figure 1:
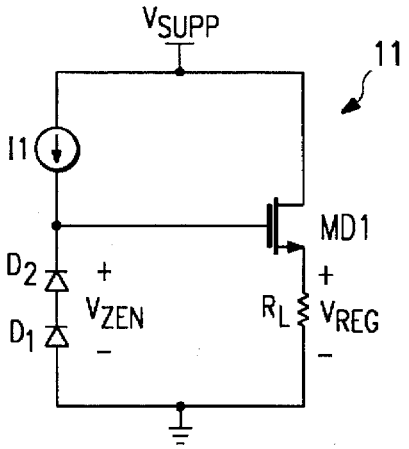
FIG. 1 (PRIOR ART)
FIG. 1 depicts a typical prior art source follower circuit.
Figure 2:
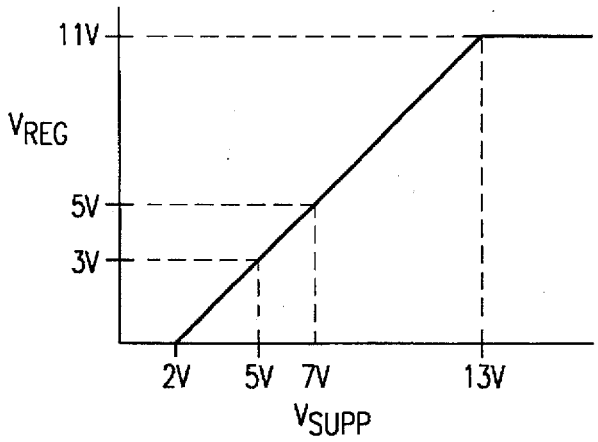
FIG. 2 (PRIOR ART)
FIG. 2 depicts the input-output voltage output characteristic for the circuit of FIG. 1.

As the voltage supply Vsupp falls below 8 Volts, the voltage at the source output of the transistor MD1 will track the supply voltage at the drain terminal of MD1, so below this point Vreg will approximately equal the supply voltage Vsupp. Thus the circuit of FIG. 3 will provide a higher output during the low supply conditions than the prior art circuit of FIG. 1, so that any circuitry coupled to voltage Vreg won't "drop out", that is stop operating, until the supply voltage reaches a lower level, for example 5 Volts. The prior art circuit had an output voltage that was 2 volts below the supply voltage in low supply conditions, and so the drop out would occur at a higher supply voltage, which in this example would be 7 volts. The use of the circuit of the invention in a system with a battery powered or self contained power supply provides a longer operating life than that obtained with the prior art circuit.

Figure 4:
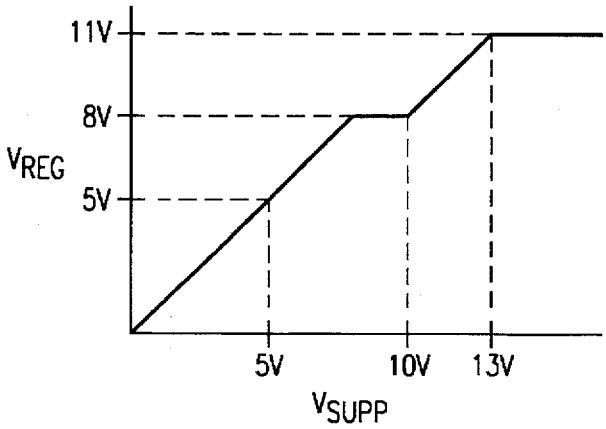
FIG. 4 depicts the input-output voltage output characteristic for the circuit of FIG. 3.

FIG. 4 depicts the output voltage characteristic for voltage Vreg for a range of supply voltages Vsupp. As the supply voltage moves from zero to 8 Volts, the output voltage Vreg is approximately equal to the supply voltage. As the supply voltage increases from 8 to 10 Volts, the source follower transistor begins operating in its normal operation mode and the regulated output voltage Vreg is less than the supply voltage by the gate to source voltage of the transistor MD1. As the supply voltage moves above 10 Volts, the voltage doubler circuitry is no longer affecting the output, and the output voltage Vreg starts moving up with the supply, but always remains below the supply voltage level by an mount approximately equal to the voltage drop Vgs from gate-to-source of the transistor MD1.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A low drop out voltage regulator circuit, comprising:

an input for receiving an oscillating input voltage;

a reference voltage terminal for receiving a reference voltage; a transistor having a drain terminal coupled to a supply voltage terminal, a source terminal coupled to an output and having a gate terminal, said transistor providing a predetermined regulated output voltage at said source terminal;

at least one diode coupled between the gate terminal of said transistor and a ground reference terminal, said diode operable for providing a predetermined voltage at said gate terminal; and a charge storage device coupled to said oscillating input voltage input and to said reference voltage terminal, said charge storage device being charged to said reference voltage and having an output coupled to said gate terminal of said transistor;

wherein said charge storage device provides a predetermined voltage at said transistor gate terminal, such that when said supply voltage falls below the specified voltage for said supply voltage the regulated voltage at the transistor source terminal transistor remains high and substantially equals said supply voltage.

2. The circuit of claim 1, wherein said charge storage device comprises:

a capacitor coupled between said oscillating input and said reference voltage terminal;

a first diode coupled between said reference voltage and the output of said capacitor to prevent charge from flowing towards said reference voltage terminal; and a second diode coupled between the output of said capacitor and the gate terminal of said transistor to prevent the transistor gate terminal from discharging current towards said capacitor.

3. The circuit of Claim 1, and further comprising an inverter coupled between said input and said charge storage device.

4. The circuit of claim 1, wherein the source terminal of said transistor is further coupled to said reference voltage terminal, such that the regulated output voltage provides the reference voltage.

5. The circuit of claim 1, and further comprising a current source circuit coupled to said voltage supply and providing a predetermined current into said serially coupled diodes.

6. The circuit of claim 1, wherein said charge storage device provides a voltage at said transistor gate terminal that is a multiple of the voltage at said reference voltage terminal.

7. The circuit of claim 6, wherein said charge storage device provides a voltage at said transistor gate terminal that is twice the voltage at said reference voltage terminal.

8. The circuit of claim 1, wherein said charge storage device comprises:

a capacitor coupled between said oscillating input and said reference voltage terminal;

a first diode coupled between said reference voltage and the output of said capacitor to prevent charge from flowing towards said reference voltage terminal; and a second diode coupled between the output of said capacitor and the transistor gate terminal to prevent current at the gate terminal of said transistor from being discharged into said capacitor.

9. A method of providing a low drop out regulator circuit, comprising the steps of:

receiving an oscillating input voltage into an input terminal;

receiving a reference voltage;

providing a transistor having a drain terminal coupled to a supply voltage terminal, coupling the transistor source terminal to an output terminal and coupling the transistor gate terminal to a current source, said transistor providing a predetermined regulated voltage at said output terminal;

coupling at least one diode between the gate terminal of said transistor and a Found reference terminal, for providing a predetermined voltage at said gate terminal;

coupling a charge storage device between said input terminal and said reference voltage terminal, said charge storage device being charged to said reference voltage and having an output coupled to said gate terminal of said transistor; and charging said charge storage device with said oscillating input voltage to a voltage equal to said reference voltage, and providing said voltage to said gate terminal such that when said supply voltage falls below the specified level for said supply voltage, the regulated voltage at the source terminal of said transistor remains high and substantially equals said supply voltage.

10. The method of claim 8, wherein said step of providing a charge storage device comprises the steps of:

coupling a capacitance between said oscillating input and said reference voltage terminal;

coupling a first diode between said reference voltage and the output of said capacitance to prevent charge from flowing towards said reference voltage terminal; and coupling a second diode between the output of said capacitor and the gate terminal of said transistor, to prevent the gate terminal of said transistor from discharging current towards said capacitor.

11. The method of claim 8, and further comprising the step of coupling an inverter between said input terminal for an oscillating signal and said charge storage device.

12. The method of claim 8, and further comprising the step of coupling the output terminal of said transistor to said reference voltage terminal, such that the regulated output voltage provides the reference voltage.

13. The method of claim 8, and further comprising the step of coupling a current source circuit to said voltage supply for providing a predetermined current into said at least one diode.

14. The method of claim 8, wherein the stop of charging said charge storage device and providing a voltage at said gate terminal of said transistor comprises providing a voltage that is a multiple of the reference voltage.

15. The method of claim 13, wherein said stop of providing a voltage that is a multiple of the reference voltage comprises providing a voltage that is twice the reference voltage.

16. The method of claim 13, wherein said stop of providing a charge storage device further comprises:

coupling a capacitance between said oscillating input and said reference voltage terminal;

coupling a first diode between said reference voltage and the output of said capacitance to prevent charge from flowing towards said reference voltage terminal; and coupling a second diode between the output of said capacitance and the gate terminal of said transistor to prevent the, gate terminal of said transistor from discharging current towards said capacitance.

* * * * *